United States Patent [19]

Fellows

[11] Patent Number: 4,678,704

[45] Date of Patent: Jul. 7, 1987

[54] IMPREGNATED SUBSTRATE INCORPORATING AN INDICATOR DYE

[75] Inventor: Adrian N. Fellows, Hedben Bridge, England

[73] Assignee: Fibre Treatments (Holding) Limited, Burnley, England

[21] Appl. No.: 889,793

[22] Filed: Jul. 24, 1986

[30] Foreign Application Priority Data

Jul. 24, 1985 [GB] United Kingdom ..... 8518736

[51] Int. Cl.[4] ..... B32B 27/00

[52] U.S. Cl. ..... 428/289; 428/290

[58] Field of Search ..... 428/289, 290

[56] References Cited

U.S. PATENT DOCUMENTS 4,165,290 8/1979 Johnson et al. ..... 428/289

*Primary Examiner*—Marion C. McCamish

*Attorney, Agent, or Firm*—Woodard, Weikart, Emhardt & Naughton

[57] ABSTRACT

An impregnated fabric material comprising a fabric substrate to which has been bonded an active cationic impregnant characterized in that there has also been applied to the substrate an anionic indicator dye in combination with a further cationic component, and in that the dye bonds to the further cationic component more readily than to the substrate and that the further cationic component competes with the impregnant for bonding to the dye. In the case of a wiping cloth, when the dye, which can act as an indicator, has been removed to indicate exhaustion of the active component, enough active component in fact remains on the cloth to provide a safety margin.

11 Claims, No Drawings

IMPREGNATED SUBSTRATE INCORPORATING AN INDICATOR DYE

In U.K. Pat. No. 2007096 I described a method of indicating the presence of an impregnant in a substrate. This invention has proved to be of particular value in indicating the presence of disinfectant compositions on wiping cloths for various applications within the food, health-care, dairy and other industries. It will be appreciated that the disinfection requirements of these industries as well as those within the domestic household can be very different. In certain instances the disinfection process may actually be little more that a cosmetic operation, in other cases, the efficiency with which the process is carried out may have direct impact on the health of persons in that area or in receipt of food, products or medical procedures influenced by the hygenic state of that environment. In this latter type of situation, there is often not only a requirement to indicate the presence and continuing efficacy of the disinfectant composition, but to do so with a significant safety margin beyond the endpoint of the indicator system.

In our U.K. Pat. No. 2007096 we described a method by which the presence and efficacy of an agent was indicated by the direct attachment or bonding of an anionic dye to cationic disinfectant which was in turn bonded to the substrate. This direct means of attachment gave a reliable indicator of the presence of useful active disinfectant whose end-point was closely correlated with the final depletion of the active composition. What we now propose is an indicator whose end-point will reliably occur whilst there is an effective proportion of active chemical or composition remaining on the substrate.

According to the invention we therefore provide an impregnated fabric material comprising a fabric substrate to which has been bonded an active cationic impregnant characterised in that there has also been applied to the substrate an anionic indicator dye in combination with a further cationic component, and in that the dye bonds to the further cationic component more readily than to the substrate and that the further cationic component competes with the impregnant for bonding to the dye.

The substrate may for example be a woven or nonwoven fabric, paper, tissue, sponge or laminate of foam and fabric. Examples of suitable nonwoven substrates would be wet-laid, dry-laid, spun bonded, spun laced, air-laid, etc. comprising either singly or in admixture fibres such as cellulose, viscose, polyester, polypropylene, polyethylene, polyamide, etc. The term substrate includes naturally occurring materials such as animal skin e.g. chamois leathers. To the substrate is bonded the cationic composition, i.e. a composition whose major active component or components is cationic. Examples of such cationic materials would be quarternary ammonium compounds such as alkyl dimethyl benzyl ammonium chlorides e.g. alkyl dimethyl ethyl-benzyl ammonium chloride, and benzalkonium chloride. Alternatively the quaternary ammonium compound may be an alkyl trimethyl ammonium bromide, cetyl pyridinium chloride, or benzethonium chloride. Preferably the alkyl chain comprises $C_{12}$ to $C_{18}$ groups. Alternatively the cationic material may be chosen from the bisguanides such as a soluble salt of 1,6-di-(4-chloro-phenylbisguanido hexane) or polymeric bisguanide such as polyhexamethylene bisguanide hydrochloride sold as Vantocil IB (Registered Trade Mark). The composition may also contain other materials such as nonionic surfactants, chelating agents, fragrances or other ancillary materials. To this impregnated substrate is then applied the indicating dye, which (as in the case of U.K. Pat. Nol 2007069) is an anionic dye but which in accordance with this invention is in combination with (for example is held in an aqueous dispersion of) a relatively large cationic molecule. Suitable dyes would be those dyes approved for food use though any anionic dye may be used. The widely approved food dyes are as follows:

Sunset Yellow FC (c.i. no. 15985), Blue X (c.i. no. 73015), Blue FCF (c.i. no. 42090), Green S (c.i. no. 44090), Amaranth (c.i. no. 16185), Ponceau 4R (c.i. no. 16255), Carmoisine (c.i. no. 14720), Geranine 2G (c.i. no. 18050), and F.D.&C. colours e.g. F.D.&C. Blue No.1.

The large cationic molecule may preferably be a cationic starch and more preferably a cold-water soluble cationic starch such as, Catogel (a Trade Mark of the National Starch Corp.).

The cationic starch molecules will associate with anionic dye molecules and hence prevent the dye anions from bonding to free positive sites on the impregnated cationic material. The lower proportion of remaining uncombined dye anions will be free to bond to the cationic impregnant but will tend to associate preferentially with the more loosely bonded or attached cations. The net effect of this modification to the indicator is that when the article, perhaps a disinfectant wipe, is activated by the addition of a polar liquid, normally water, then that proportion of active chemical, in this case disinfectant, which is bonded or electrostatically attached to the dye anions is released more readily than that proportion which is more firmly attached to the substrate. The neutralised cationic starch-anionic dye complex is also relatively readily released although this is usefully controlled by the nature of the starch's solubility. Hence, the indicator disappears while leaving a significant proportion of active chemical on the cloth, providing a valuable safety margin.

Another useful feature of the cationic starches is their ability to thicken the dye solution, facilitating the manufacture of articles within the scope of the invention having attractive clearly-delineated indicators, for instance in stripes or other appropriate configurations.

Some examples of products within the scope of the invention are as follows:

(1) A viscose nonwoven fabric impregnated with a cationic composition to give the following loadings expressed as percentages of the nonwoven weight:

| | |
|---|---|
| Polyhexamethylene bisguanide hydrochloride | 3.6% |
| Alkyl dimethyl benzyl ammoniumchloride | 8.9% |

marked with an indicator composition of the following composition:

| | % by weight in water |
|---|---|
| F D and C Blue No. 1 dye | 0.3% |
| Catogel | 0.25% |

(2) A wet-laid nonwoven fabric made from a combination of viscose and regenerated wood-pulp fibres with an acrylic binder impregnated with a cationic composition to give the following loadings expressed as percentages of the nonwoven weight.

| | |
|---|---|
| Chlorhexidine gluconate | 3.0% |
| Alkyl dimethyl benzyl ammonium chloride | 7.0% |
| with an indicator comprising as follows: | |
| F D and C Blue No. 1 dye | 0.3% |
| Catogel Extra | 0.50% |

(3) A spun bond polypropylene nonwoven fabric impregnated with a cationic composition to give the following loadings expressed as percentages of the nonwoven weight.

| | |
|---|---|
| Polyhexamethylene Bisguanide hydrochloride (Vantocil IB) | 5.0% |
| Cetyl trimethyl ammonium bromide | 2.5% |
| With an indicator comprising as follows: | |
| Carmoisine | 0.05% |
| Catogel | 0.25% |

The above formulations are only exemplary and are not to be construed as limiting the invention.

I claim:

1. An impregnated fabric material comprising a fabric substrate to which has been bonded an active cationic impregnant characterized in that there has also been applied to the substrate an anionic indicator dye in combination with a further cationic component, and in that the dye bonds to the further cationic component more readily than to the substrate and that the further cationic component competes with the impregnant for bonding to the dye.

2. An impregnated fabric material according to claim 1, wherein the dye bonds to the further cationic component more readily than to the impregnant.

3. An impregnant fabric material according to claim 1 wherein the further cationic component is larger than the first, active, cationic component.

4. An impregnated fabric material according to claim 1 wherein the molecules of the further cationic component are larger than those of the dye.

5. An impregnated fabric material according to claim 1 in which the further cationic component is a cationic starch.

6. An impregnated fabric material according to claim 1 in which the impregnant is an antimicrobial composition.

7. An impregnated fabric material according to claim 6 in which the antimicrobial composition exhibits cationic character when in solution.

8. An impregnated fabric material according to claim 1 in which the impregnant has been uniformly applied to the substrate.

9. An impregnated fabric material according to claim 1 in which the indicator dye composition has been applied to the substrate in stripes.

10. An impregnated fabric material according to claim 1 wherein the substrate is a woven or nonwoven fabric, paper, tissue, sponge or laminate of foam and fabric.

11. An impregnated fabric material according to claim 1 wherein the cationic impregnant is a quaternary ammonium compound, bisguanide or polymeric bisguanide.

* * * * *